US009994372B2

(12) United States Patent
Dzikowicz et al.

(10) Patent No.: US 9,994,372 B2
(45) Date of Patent: Jun. 12, 2018

(54) CLOSURE APPARATUS FOR FLEXIBLE POUCH

(71) Applicant: Nestec S.A., Vevey (CH)

(72) Inventors: Anthony Edward Dzikowicz, Grand Haven, MI (US); Brooke Susan Ruble, Grand Rapids, MI (US); Joel Dean Genaw, Hesperia, MI (US)

(73) Assignee: Nestec S.A., Vevey (CH)

( * ) Notice: Subject to any disclaimer, the term of this patent is extended or adjusted under 35 U.S.C. 154(b) by 41 days.

(21) Appl. No.: 14/702,867

(22) Filed: May 4, 2015

(65) Prior Publication Data

US 2015/0321809 A1 Nov. 12, 2015

Related U.S. Application Data

(60) Provisional application No. 61/989,496, filed on May 6, 2014.

(51) Int. Cl.
*B65D 35/28* (2006.01)
*B65D 35/32* (2006.01)
(Continued)

(52) U.S. Cl.
CPC ..... *B65D 51/24* (2013.01); *B65D 33/16* (2013.01); *B65D 33/1666* (2013.01); *B65D 33/1675* (2013.01); *B65D 75/5883* (2013.01)

(58) Field of Classification Search
CPC ..... B65D 33/1658; B65D 33/1666; B65D 33/1675; B65D 75/5861; B65D 75/5872;
(Continued)

(56) References Cited

U.S. PATENT DOCUMENTS 4,928,851 A * 5/1990 Eatherly ..... B65D 35/28 222/103
4,979,668 A * 12/1990 Allen ..... B65D 5/069 229/125.12
5,931,117 A * 8/1999 Lantz ..... B65D 33/00 119/65
6,058,572 A 5/2000 Folkmar
(Continued)

FOREIGN PATENT DOCUMENTS

GB 550730 A 1/1943
JP 2002160756 A * 6/2002
WO 2010078898 A1 7/2010

OTHER PUBLICATIONS

JP2002160756Translation.*
(Continued)

*Primary Examiner* — Jes F Pascua
*Assistant Examiner* — Nina Attel
(74) *Attorney, Agent, or Firm* — Gary M. Lobel, Esq.

(57) ABSTRACT

A closure apparatus for use with a flexible pouch containing a flowable material and having a spout for discharging the flowable material from the pouch, comprising a cap member sealingly engageable with the spout and a clip assembly extending from the cap member, the clip assembly comprising a first clip member; and a second clip member connected to the first clip member and cooperating with the first clip member to define a pouch receiving space, the first clip member and the second clip member having a pouch clip position such that the first clip member and the second clip member restrict the flow of the flowable material through the pouch when at least a portion of the pouch is positioned in the pouch receiving space.

11 Claims, 6 Drawing Sheets

(51) Int. Cl.

| | |
|---|---|
| ***B65D 51/24*** | (2006.01) |
| ***B65D 55/16*** | (2006.01) |
| ***B65D 33/16*** | (2006.01) |
| ***B65D 75/58*** | (2006.01) |

(58) Field of Classification Search

CPC ..... B65D 75/5877; B65D 75/5883; B65D 5/069; B65D 5/063; B65D 5/066; B65D 33/1641; B65D 45/16; B65D 81/3266; B65D 41/26; B65D 33/16; B65D 33/1616; B65D 33/1625; B65D 33/1633; B65D 77/245; B65D 51/24; B65D 51/246; B65D 51/26; B65D 51/32; B65D 55/16; B65D 55/165; B65D 35/28; A47J 43/287

USPC ..... 24/30.5 R, 30.5 S; 383/68, 69; 215/390, 215/391, 227–229, 386, 306; 220/379, 220/735, 738, 740, 744; 222/103, 95, 96, 222/99; 248/311.2, 312, 312.1; 224/269; 206/216

See application file for complete search history.

(56) References Cited

U.S. PATENT DOCUMENTS

| | | | | |
|---|---|---|---|---|
| 6,378,731 | B1 * | 4/2002 | Klabes | B65D 75/5883 222/567 |
| 6,749,087 | B1 * | 6/2004 | Robinson | B65D 35/28 222/1 |
| 2002/0066758 | A1 * | 6/2002 | Fadal, II | A45F 3/16 224/148.7 |
| 2005/0258204 | A1 * | 11/2005 | Evans | A45F 5/02 224/197 |
| 2006/0053753 | A1 | 3/2006 | Ha et al. | |
| 2006/0174493 | A1 | 8/2006 | Hsu | |
| 2006/0191936 | A1 * | 8/2006 | De Laforcade | B65D 51/223 220/278 |
| 2013/0305492 | A1 * | 11/2013 | Taylor | B65D 33/1675 24/30.5 R |

OTHER PUBLICATIONS

International Search Report and Written Opinion from corresponding PCT patent application No. PCT/IB2015/053244 dated Jul. 13, 2015.

* cited by examiner

CLOSURE APPARATUS FOR FLEXIBLE POUCH

BACKGROUND

Flexible pouches for containing food and beverage products are frequently marketed for use by infants and children. The flexible pouches are convenient, inexpensive, and provide ease of use. Typically, a spout is used to discharge the product from the flexible pouch. However, because of the pliable nature of the pouches, the rate of flow of the product from the spout is not well controlled. For example, children may squeeze the pouch with too much force and produce an unwanted rate of flow.

To this end, a need exists for an improved apparatus for controlling the flow of material from a flexible pouch and for delivering such an apparatus in a convenient and useful manner with the pouch. It is to such apparatus that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations.

DETAILED DESCRIPTION OF EXEMPLARY EMBODIMENTS

Figure 1:
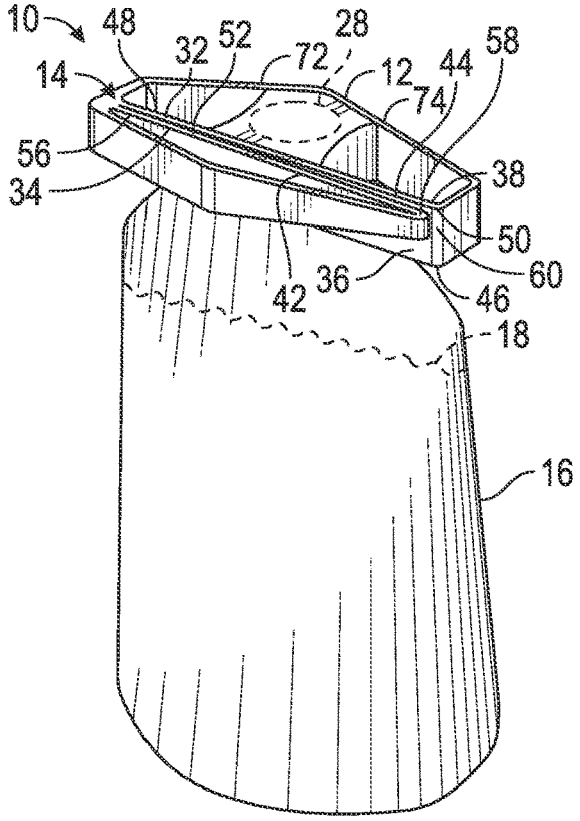
FIG. 1 is a perspective view of a closure apparatus constructed in accordance with the inventive concepts disclosed herein shown sealingly engaged with a flexible pouch.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
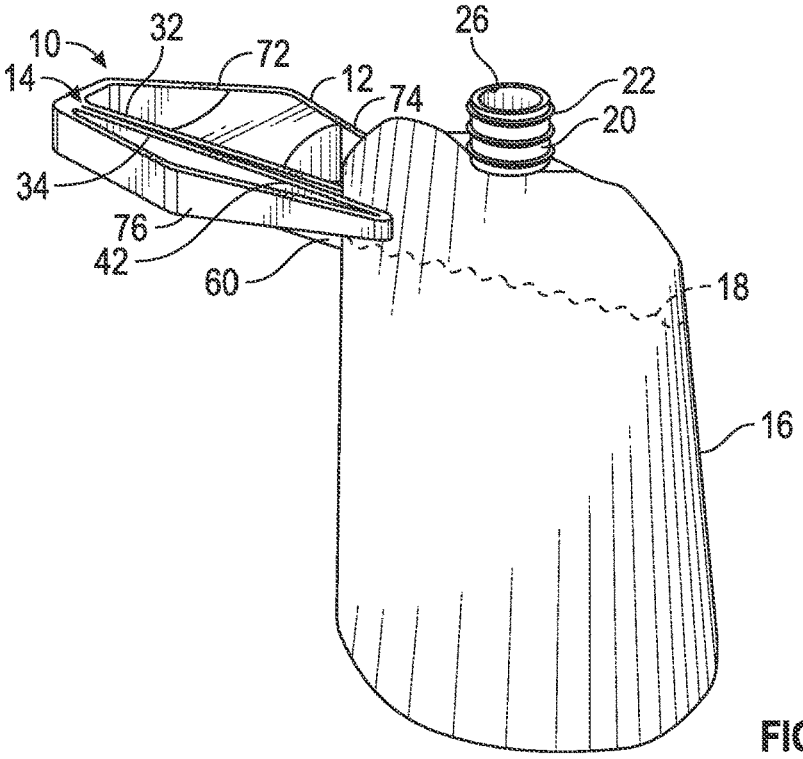
FIG. 2 is a perspective view of the closure apparatus of FIG. 1 shown in a pouch clip position.
Figure 3:
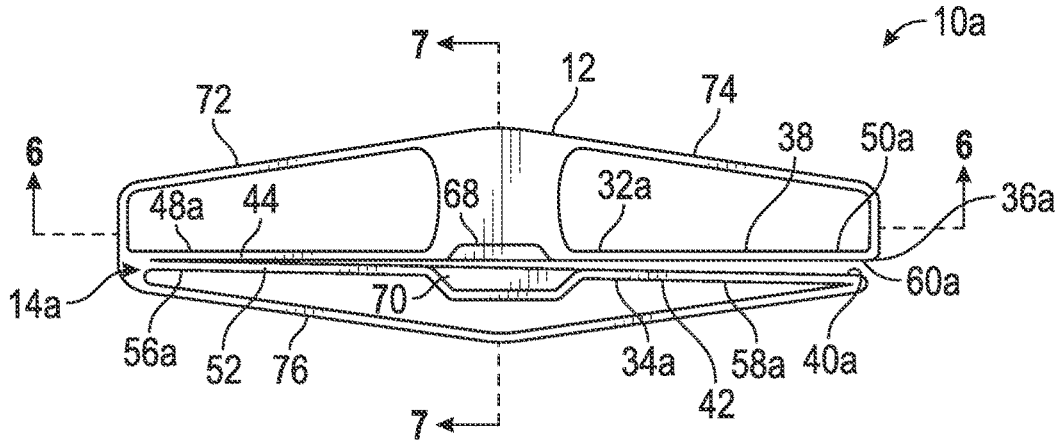
FIG. 3 is a top plan view of another embodiment of a closure apparatus constructed in accordance with the inventive concepts disclosed herein.
Figure 4:
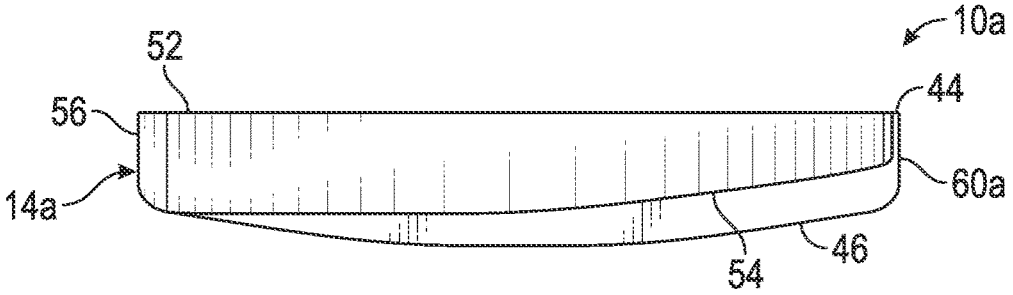
FIG. 4 is a side elevational view of the closure apparatus of FIG. 3.
Figure 5:
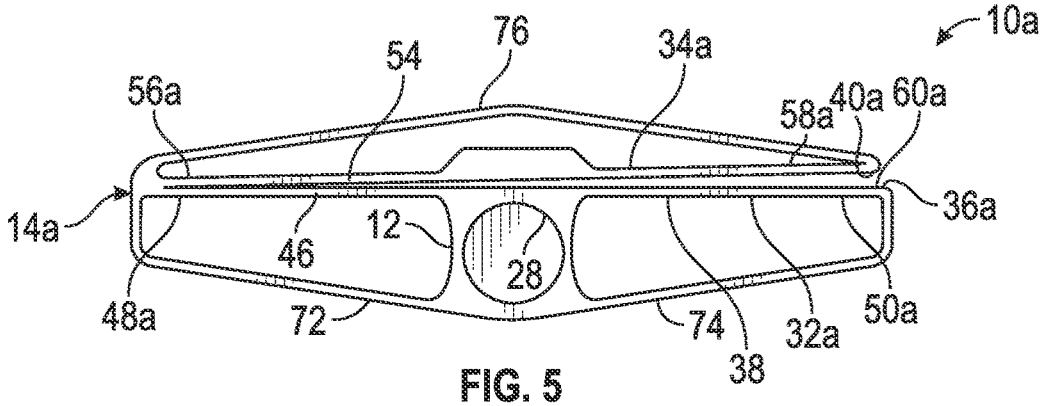
FIG. 5 is a bottom plan view of the closure apparatus of FIG. 3.
Figure 6:
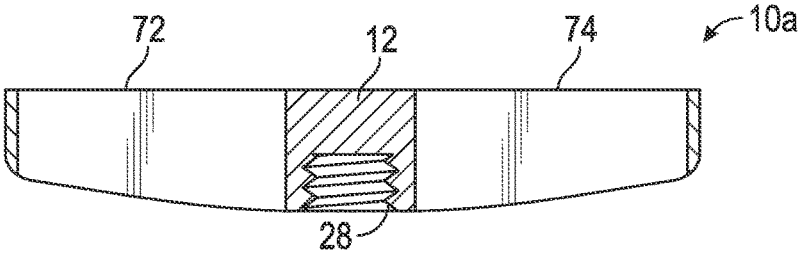
FIG. 6 is a cross-sectional view of the closure apparatus taken along line 6-6 of FIG. 3.
Figure 7:
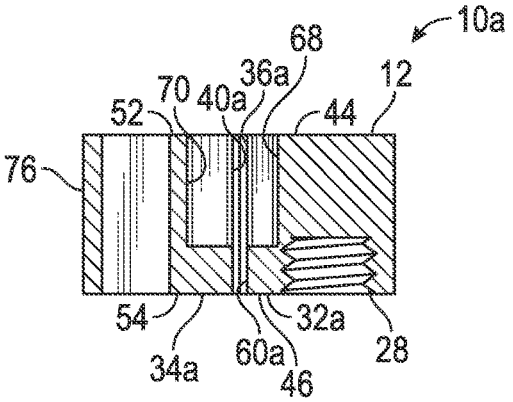
FIG. 7 is a cross-sectional view of the closure apparatus taken along line 7-7 of FIG. 3.

Referring now to the drawings, and more particularly to FIGS. 1 and 2, a closure apparatus 10 comprising a cap member 12 and a clip assembly 14 extending from the cap member 12 is shown in conjunction with a flexible pouch 16 containing a flowable material 18 and having a spout 20. Flexible pouches are well known by those having skill in the art and, therefore, will not be described in detail herein. In general, the flexible pouch 16 may be comprised of any non-permeable flexible material. For example, the flexible pouch 16 may be made of one or more flexible sheets, such as polymer sheets or foil sheets. The flexible pouch 16 may be used to contain any flowable material 18. Non-exclusive examples of flowable material 18 include food, beverages, granules, and gases. In one example, the flexible pouch 16 contains flowable material 18 comprising pureed food products or beverages designed for consumption by children.

Figure 8:
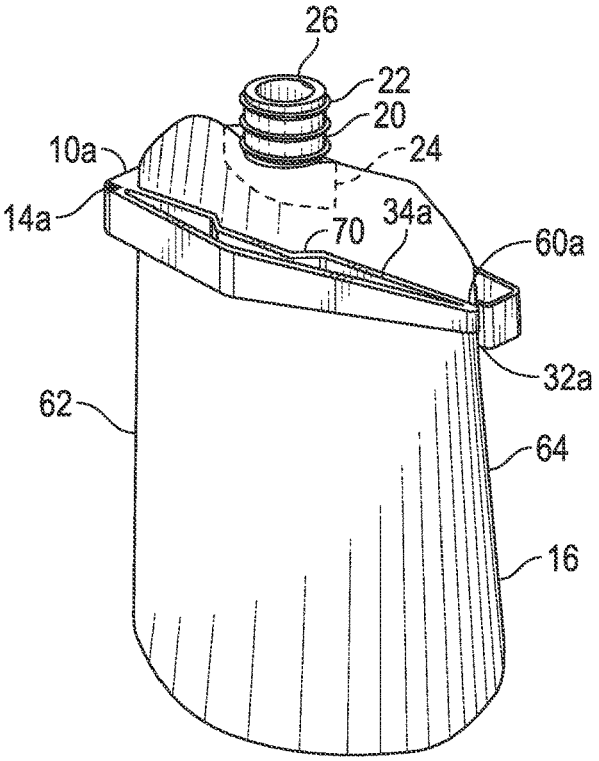
FIG. 8 is a perspective view of the closure apparatus of FIG. 3 shown in a pouch clip position.

The flexible pouch 16 has a spout 20 for discharging the flowable material 18. The spout 20 has a top portion 22 extending from the flexible pouch 16. The spout 20 may be cylindrical and the top portion 22 may be externally threaded. The spout may have a bottom portion 24 disposed within the pouch 16, as well as a through-channel 26 for discharging the flowable material 18 from the pouch 16 (FIG. 8). However, it will be understood that any spout 20 may be used that is capable of matingly engaging the cap member 12.

As shown in FIGS. 1 and 2, in one embodiment, the closure apparatus 10 has a cap member 12 having a threaded cylindrical recess 28 for receiving and sealing the spout 20. The cylindrical recess 28 has a longitudinal axis. In one embodiment, the threaded cylindrical recess 28 is positioned centrally in the cap member 12. The cap member 12 and the spout 20 are shown as matingly threaded, however, it will be understood that other engagement means may be used, such as a snap-fit. Additionally, the cap member 12 or the spout 20 may have a safety seal (not shown).

The clip assembly 14 extends from the cap member 12 and includes a first clip member 32 and a second clip member 34. The first clip member 32 has an inner side 36 facing the second clip member 34 and an outer side 38. The second clip member 34 has an inner side 40 facing the first clip member 32 and an outer side 42. The first clip member 32 may have a top 44, a bottom 46, a proximal end 48, and a distal end 50. The second clip member 34 may have a top 52, a bottom 54, a proximal end 56, and a distal end 58. The second clip member 34 is connected to the first clip member 32. In one embodiment, the proximal end 56 of the second clip member 34 is connected to the proximal end 48 of the first clip member 32. The second clip member 34 cooperates with the first clip member 32 to form a pouch receiving space 60 having a longitudinal axis. The cap member 12 is shown extending from the outer side 38 of the first clip member 32. In one embodiment, the cap member 12 is positioned centrally between the proximal end 48 and the distal end 50 of the first clip member 32. However, it will be understood that the cap member 12 alternately could extend from the outer side 42 of the second clip member 34 or from any portion of the clip assembly 14 as long as the cap member 12 does not interfere with the pouch receiving space 60.

Figure 13:
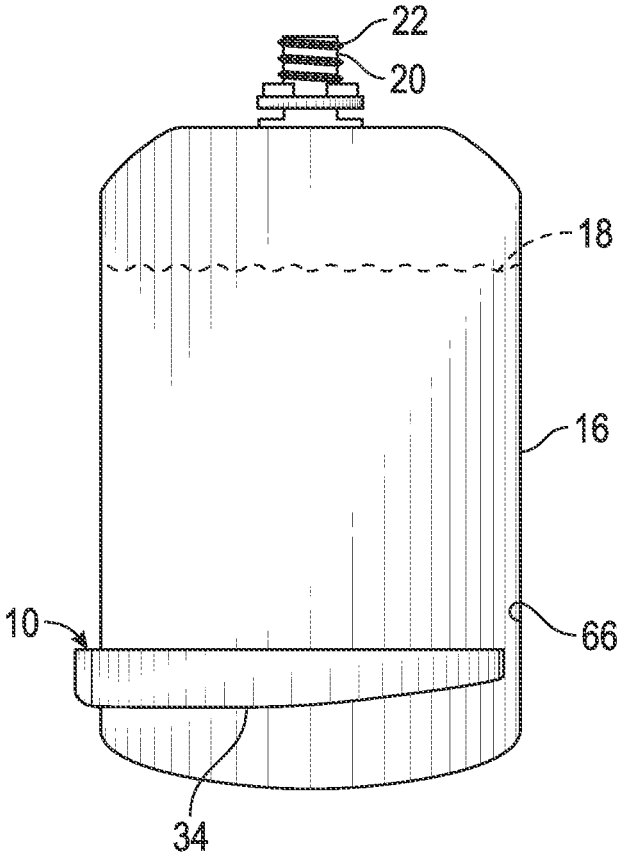
FIG. 13 is a side elevational view of the closure apparatus of FIG. 1 shown in a pouch clip position.

The first clip member 32 and the second clip member 34 have a pouch clip position such that the first clip member 32 and the second clip member 34 are positioned to restrict, or prevent, the flow of the flowable material 18 through the pouch 16 when at least a portion of the pouch 16 is positioned in the pouch receiving space 60 (FIGS. 2 and 13). The first clip member 32 and the second clip member 34 may be spaced from each other such that the first clip member 32 and the second clip member 34 restrict the flow of the material 18 through the pouch 16 when in the pouch clip position. Alternatively, the first clip member 32 and the second clip member 34 may be spaced from each other such that the first clip member 32 and the second clip member 34 prevent the flow of the material 18 through the pouch 16 when in the pouch clip position.

The longitudinal axis of the cap member 12 is laterally offset from the longitudinal axis of the pouch receiving space 60 such that the cap member 12 is spaced from the pouch 16 when the first clip member 32 and the second clip member 34 are about the pouch 16 in the pouch clip position (FIG. 2). Though the longitudinal axis of the cylindrical recess 28 is shown as being at a right angle to the longitudinal axis of the pouch receiving space 60, the longitudinal axis of the cylindrical recess 28 may be in any angular relationship (including parallel to) the longitudinal axis of the pouch receiving space 60, as long as the cap member 12 does not interfere in the pouch receiving space 60.

In one embodiment, the first clip member 32 and the second clip member 34 are movable relative to one another and biased in the pouch clip position. Alternatively, in another embodiment, the first clip member 32 and the second clip member 34 are fixed relative to each other, thereby fixing the pouch receiving space 60.

In one embodiment, as shown in FIG. 8, the pouch 16 has a first side 62 and a second side 64 with a width between the first side 62 and the second side 64, and the first clip member 32 and the second clip member 34 extend the width of the pouch 16, thereby restricting or preventing flow of the material 18 from the pouch 16. Alternatively, at least one of the first clip member 32 and the second clip member 34 may extend less than the width of the pouch 16, thereby forming a flow channel 66 for the flowable material 18 in the pouch 16 (see FIG. 13).

As shown in FIGS. 1-5, in one embodiment, at least one of the bottom 46 of the first clip member 32 and the bottom 54 of the second clip member 34 may be curved toward the top 44 of the first clip member 32 and the top 52 of the second clip member 34. The first clip member 32 may be curved less than the second clip member 34, thereby easing the positioning of the first clip member 32 and the second clip member 34 about the pouch 16 to reach the pouch clip position.

Shown in FIGS. 3-8 is another embodiment of a closure apparatus 10*a* substantially similar to the closure apparatus 10 previously described, except the closure apparatus 10*a* has a clip assembly 14*a* as described herein below. In the closure apparatus 10*a*, the clip assembly 14*a* has a first clip member 32*a* and a second clip member 34*a* having inner sides 36*a*, 40*a* facing one another. The second clip member 34*a* is connected to the first clip member 32*a*. The second clip member 34*a* cooperates with the first clip member 32*a* to form a pouch receiving space 60*a* having a longitudinal axis. The first clip member 32*a* and the second clip member 34*a* have a pouch clip position (FIG. 8) such that the first clip member 32*a* and the second clip member 34*a* are positioned to restrict, or prevent, the flow of the flowable material 18 through the pouch 16 when at least a portion of the pouch 16 is positioned in the pouch receiving space 60*a*.

The first clip member 32*a* and the second clip member 34*a* have opposing spout-receiving recesses 68, 70 on the inner sides 36*a*, 40*a* of the first clip member 32*a* and the second clip member 34*a*. The spout-receiving recesses 68, 70 are matingly engageable with the bottom portion 24 of the spout 20 when the first clip member 32*a* and the second clip member 34*a* are in the pouch clip position (FIG. 8). The engagement of the bottom portion 24 of the spout 20 with the spout-receiving recesses 68, 70 secures the clip assembly 14*a* to the spout 20 and the pouch 16.

As shown in FIGS. 1-7, the first clip member 32, 32*a* may have at least one support arm extending from the first clip member 32, 32*a* to the cap member 12. In one embodiment, a first support arm 72 extends from the proximal end 48, 48*a* of the first clip member 32, 32*a* to the cap member 12 and a second support arm 74 extends from the distal end 50, 50*a* of the first clip member 32, 32*a* to the cap member 12. In one embodiment, a third support arm 76 extends from the proximal end 56, 56*a* of the second clip member 34, 34*a* to the distal end 58, 58*a* of the second clip member 34, 34*a*. Of course, it will be understood that any number of support arms 72, 74, 76 may be used and the support arms 72, 74, 76 may be any size.

Figure 9:
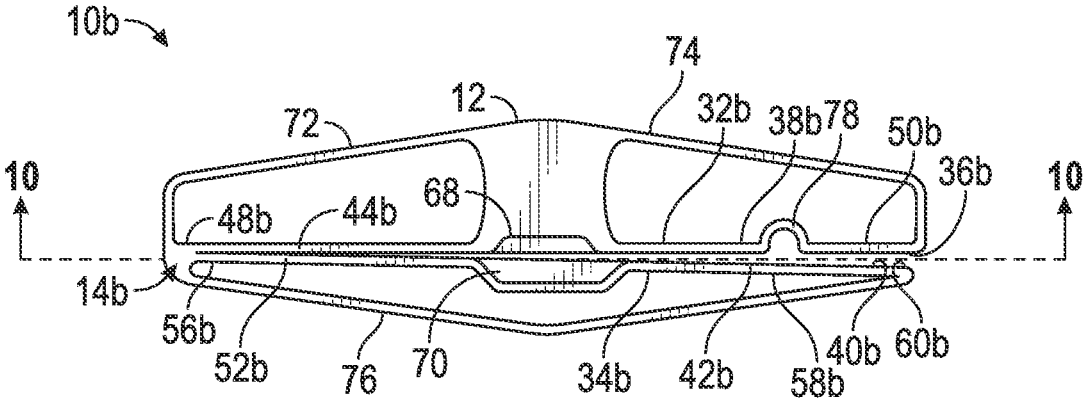
FIG. 9 is a top plan view of another embodiment of a closure apparatus constructed in accordance with the inventive concepts disclosed herein.
Figure 10:
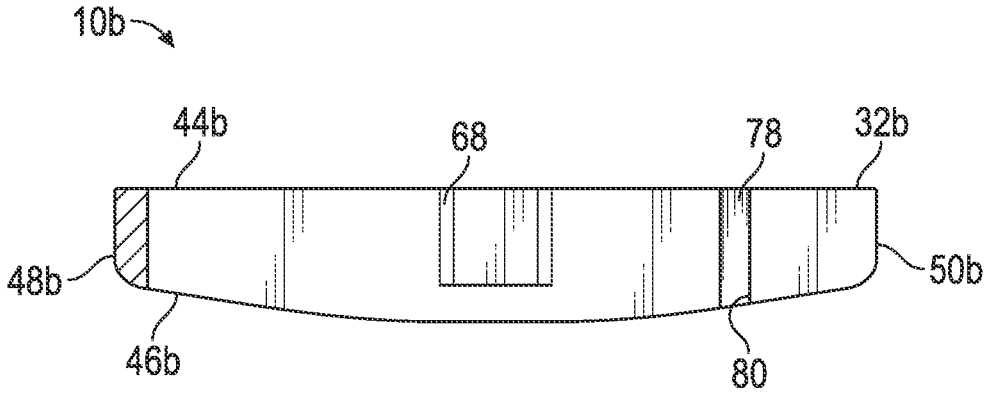
FIG. 10 is a cross-sectional view of the closure apparatus taken along line 10-10 of FIG. 9.

Illustrated in FIGS. 9 and 10 is another embodiment of a closure apparatus 10*b* substantially similar to the closure apparatuses 10, 10*a* previously described, except the closure apparatus 10*b* has a clip assembly 14*b* as described herein below. The clip assembly 14*b* extends from the cap member 12 and includes a first clip member 32*b* and a second clip member 34*b*. The first clip member 32*b* has an inner side 36*b* facing the second clip member 34*b* and an outer side 38*b*. The second clip member 34*b* has an inner side 40*b* facing the first clip member 32*b* and an outer side 42*b*. The first clip member 32*b* may have a top 44*b*, a bottom 46*b*, a proximal end 48*b*, and a distal end 50*b*. The second clip member 34*b* may have a top 52*b*, a bottom 54*b*, a proximal end 56*b*, and a distal end 58*b*. The second clip member 34*b* is connected to the first clip member 32*b*. The second clip member 34*b* cooperates with the first clip member 32*b* to form a pouch receiving space 60*b* having a longitudinal axis.

The first clip member 32*b* and the second clip member 34*b* have a pouch clip position such that the first clip member 32*b* and the second clip member 34*b* are positioned to restrict the flow of the flowable material 18 through the pouch 16 when at least a portion of the pouch 16 is positioned in the pouch receiving space 60*b*. At least one of the first clip member 32*b* and the second clip member 32*b* has a recess 78 positioned between the proximal end 48*b*, 56*b* and the distal end 50*b*, 58*b* and extending from the bottom 46*b*, 54*b* to the top 44*b*, 52*b* thereby defining a flow channel 80 for the flowable material 18 in the pouch 16 when the dip assembly 14*b* is in the clip pouch position.

Figure 11:
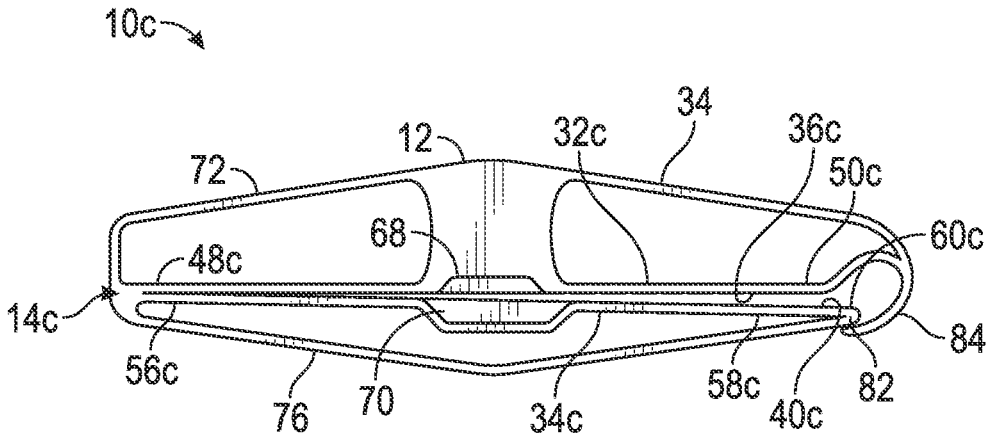
FIG. 11 is a top plan view of another embodiment of a closure apparatus constructed in accordance with the inventive concepts disclosed herein.

Illustrated in FIG. 11 is another embodiment of a closure apparatus 10*c* substantially similar to the closure apparatuses 10, 10*a* previously described, except the closure apparatus 10*c* has a clip assembly 14*c* securable on the pouch 16. In the closure apparatus 10*c*, the clip assembly 14*c* has a first clip member 32*c* and a second clip member 34*c* having inner sides 36*c*, 40*c* facing one another. The first clip member 32*c* has a proximal end 48*c* and a distal end 50*c*. The second clip member 34*c* has a proximal end 56*c* and a distal end 58*c*. The proximal end 56*c* of the second clip member 34*c* is connected to the proximal end 48*c* of the first clip member 32*c*. The second clip member 34*c* cooperates with the first clip member 32*c* to form a pouch receiving space 60*c* having a longitudinal axis. The first clip member 32*c* and the second clip member 34*c* have a pouch clip position such that the first clip member 32*c* and the second clip member 34*c* are positioned to restrict, or prevent, the flow of the flowable material 18 through the pouch 16 when at least a portion of the pouch 16 is positioned in the pouch receiving space 60*c*.

The distal end 58*c* of the second clip member 34*c* is connectable to the distal end 50*c* of the first clip member 32*c*. When the clip assembly 14*c* is in the pouch clip position and the distal end 58*c* of the second clip member 34*c* is connected to the distal end 50*c* of the first clip member 32*c*, the clip assembly 14*c* is secured in the pouch clip position. In one embodiment, the distal end 58*c* of the second clip member has a tongue 82 and the distal end 50*c* of the first clip member 32*c* has a receiver 84 to secure the first clip member 32*c* to the second clip member 34*c*. It will be understood, however, that any latching mechanism capable of securing the first clip member 32 and the second clip member 34 in the pouch clip position may be used.

Figure 12:
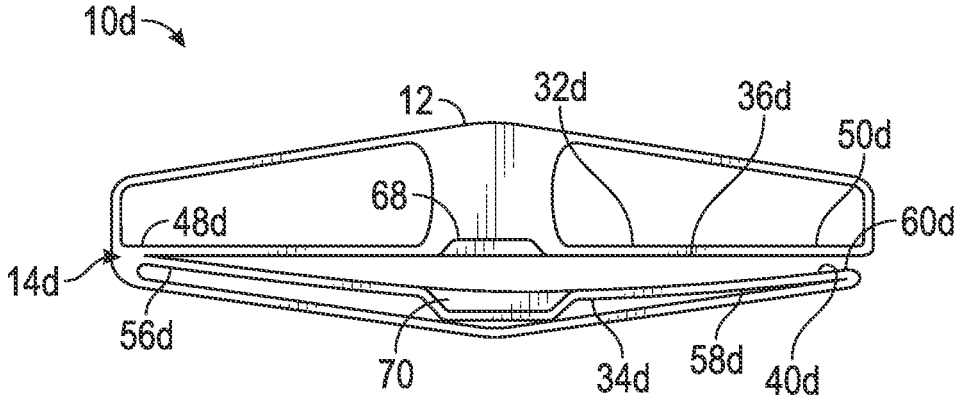
FIG. 12 is a top plan view of yet another embodiment of a closure apparatus constructed in accordance with the inventive concepts disclosed herein.

As illustrated in FIG. 12, in one embodiment, a closure apparatus 10*d* is substantially similar to the closure apparatuses 10, 10*a* previously described, except the closure apparatus 10*d* has a clip assembly 14*d*. In apparatus 10*d*, the clip assembly 14*d* has a first clip member 32*d* and a second clip member 34*d* having inner sides 36*d*, 40*d* facing one another. The first clip member 32*d* has a proximal end 48*d* and a distal end 50*d*. The second clip member 34*d* has a proximal end 56*d* and a distal end 58*d*. The proximal end 56*d* of the second clip member 34*d* is connected to the proximal end 48*d* of the first clip member 32*d*. The second clip member 34*d* cooperates with the first clip member 32*d* to form a pouch receiving space 60*d* having a longitudinal axis. The first clip member 32*d* and the second clip member 34*d* have a pouch clip position such that the first clip member 32*d* and the second clip member 34*d* are positioned to restrict, or prevent, the flow of the flowable material 18 through the pouch 16 when at least a portion of the pouch 16 is positioned in the pouch receiving space 60*d*. At least one of the inner side 36*d* of the first clip member 32*d* and the inner side 40*d* of the second clip member 34*d* curves away from the other inner side 36*d*, 40*d* between the proximal ends 48*d*, 56*d* and the distal ends 50*d*, 58*d*.

Referring now to FIGS. 1-8, and 13, methods of use of the closure apparatuses 10, 10*a* will be described. As illustrated in FIG. 1, initially the cap member 12 may receive and seal the top portion 22 of the spout 20. As illustrated in FIG. 2, a user may disengage the cap member 12 from the spout 20 and optionally position the first clip member 32, 32*a* and second clip member 34, 34*a* of the clip assembly 14, 14*a* about the pouch 16 in the clip pouch position in order to restrict or prevent flow of the material 18 through the pouch 16.

As illustrated in FIGS. 3-8, in the embodiment in which the closure apparatus 10*a* has the spout-receiving recesses 68, 70 described previously, the user may position the first clip member 32*a* and second clip member 34*a* of the clip assembly 14*a* about the pouch 16 and then matingly engage the bottom portion 24 of the spout 20 with the spout-receiving recesses 68, 70 (FIG. 8), helping to secure the closure apparatus 10*a* to the spout 20 and pouch 16. The closure apparatus 10*a* may be used to restrict flow of material 18 from the pouch 16. Alternatively, the closure apparatus 10*a* may be used to prevent flow of the material 18 from the pouch 16.

As illustrated in FIG. 11, the user may secure, or further secure, the closure apparatus 10*c* to the pouch 16 by connecting the distal end 58*c* of the second clip member 34*c* to the distal end 50*c* of the first clip member 32*c*.

As illustrated in FIGS. 8 and 13, in one embodiment, the closure apparatus 10 prevents flow of material 18 from at least a portion of the pouch 16. The closure apparatus 10 may be positioned on the pouch 16 to allow a user to access the material 18 between the spout 20 and the closure apparatus 10, but to prevent the user from accessing the material 18 beyond the position of the closure apparatus 10, for example, to allow the user to intake a portion of the material 18, but not all.

In another method of use, the first clip member 32 and the second clip member 34 may be positioned about the pouch 16 below the spout 20 in the pouch clip position. The clip assembly 14 then may be moved toward the spout 20 while the first clip member 32 and the second clip member 34 are in the pouch clip position, thereby forcing the material 18 in the pouch 16 to flow towards, and discharge from, the spout 20.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and claimed herein.

What is claimed is:

1. An apparatus comprising:

a flexible pouch containing a flowable material, the pouch having a width;

a spout having a top portion extending from the pouch, a bottom portion disposed within the pouch, and a through-channel for discharging the flowable material from the pouch;

a cap member sealingly engageable with the spout, the cap member having a recess for receiving the spout, the recess having a longitudinal axis; and a clip assembly extending from the cap member, the clip assembly comprising:

a first clip member extending from the cap member and having a proximal end and a distal end, the proximal end and the distal end fixed relative to the cap member; and a second clip member having a proximal end and a distal end, the proximal end of the second clip member connected to the proximal end of the first clip member and cooperating with the first clip member to define a pouch receiving space having a longitudinal axis extending from the proximal ends of the first and second clip members to the distal ends of the first and second clip members in a non-intersecting and non-parallel relationship to the longitudinal axis of the recess of the cap member, the first clip member and the second clip member having a pouch clip position wherein the first clip member and the second clip member are postionable on either side of the pouch to extend substantially the width of the pouch such that the first clip member and the second clip member cooperate to restrict the flow of the flowable material through the pouch when the pouch is positioned in the pouch receiving space.

2. The apparatus of claim 1, wherein the first clip member and the second clip member each have an inner side and an outer side, and wherein the first clip member and the second clip member have opposing spout-receiving recesses on the inner sides matingly engageable with the bottom portion of the spout when the first clip member and the second clip member are in the pouch clip position.

3. The apparatus of claim 1, wherein the first clip member and the second clip member are movable relative to one another and biased in the pouch clip position.

4. The apparatus of claim 1, wherein the first clip member and the second clip member are fixed relative to each other.

5. The apparatus of claim 1, wherein the proximal end of the first clip member is positioned a distance away from one side of the cap member and the distal end of the first clip member is positioned a distance away from an opposing side of the cap member.

6. The apparatus of claim 1, wherein the first clip member has an inner side facing the second clip member and an outer side and wherein the cap member extends from the outer side of the first clip member.

7. The apparatus of claim 1, wherein the second clip member extends less than the width of the pouch, thereby forming a flow channel in the pouch beyond the second clip member.

8. The apparatus of claim 1, wherein the distal end of the second clip member is connectable to the distal end of the first clip member to secure the first clip member and the second clip member in the pouch clip position.

9. A method for flow control of a flowable material contained in a flexible pouch having a spout for discharging the flowable material from the pouch, comprising:

disengaging a closure apparatus from the spout, the closure apparatus comprising a cap member sealingly engageable with the spout and a clip assembly extending from the cap member, the cap member having a recess for receiving the spout, the recess having a longitudinal axis, the clip assembly comprising:

a first clip member extending from the cap member and having a proximal end and a distal end, the proximal end and the distal end fixed relative to the cap member; and a second clip member having a proximal end and a distal end, the proximal end of the second clip member connected to the proximal end of the first clip member in a way that the second clip member cooperates with the first clip member to define a pouch receiving space having a longitudinal axis extending from the proximal ends of the first and second clip members to the distal ends of the first and second clip members in a non-intersecting and non-parallel relationship to the longitudinal axis of the recess of the cap member; and positioning the first clip member and the second clip member about the pouch in a pouch clip position such that the first clip member and the second clip member restrict the flow of the flowable material through the pouch when at least a portion of the pouch is positioned in the pouch receiving space.

10. The method of claim 9, wherein the spout has a bottom portion and wherein the method further comprises the step of:

matingly engaging the bottom portion of the spout with at least one of the first clip member and the second clip member.

11. The method of claim 9, further comprising:

discharging at least a portion of the flowable material from the spout by moving the clip assembly toward the spout while the first clip member and the second clip member are in the pouch clip position.

* * * * *